US007472693B2

(12) United States Patent
Izutani et al.

(10) Patent No.: US 7,472,693 B2
(45) Date of Patent: Jan. 6, 2009

(54) FUEL FEED APPARATUS HAVING FUEL PUMP AND FILTER

(75) Inventors: Kouji Izutani, Nagoya (JP); Noriya Matsumoto, Okazaki (JP); Keiichi Yamashita, Kariya (JP)

(73) Assignee: Denso Corporation (JP)

( * ) Notice: Subject to any disclaimer, the term of this patent is extended or adjusted under 35 U.S.C. 154(b) by 303 days.

(21) Appl. No.: 11/305,164

(22) Filed: Dec. 19, 2005

(65) Prior Publication Data

US 2006/0138035 A1 Jun. 29, 2006

(30) Foreign Application Priority Data

Dec. 27, 2004 (JP) ..... 2004-376261

(51) Int. Cl.
*F02M 37/04* (2006.01)
*F02M 37/08* (2006.01)

(52) U.S. Cl. ..... 123/509

(58) Field of Classification Search ..... 123/509, 123/514, 510, 467, 446; 137/565.22, 565.17, 137/571; 210/172.4
See application file for complete search history.

(56) References Cited

U.S. PATENT DOCUMENTS 6,644,289 B2 * 11/2003 Noda ..... 123/509
6,840,231 B2 * 1/2005 Suzuki ..... 123/509
6,923,164 B1 * 8/2005 Mitsudou et al. ..... 123/509
7,112,278 B2 9/2006 Yamada et al.
2004/0000344 A1 * 1/2004 Okabe et al. ..... 137/565.22
2004/0112819 A1 6/2004 Ebihara et al.
2004/0168678 A1 * 9/2004 Yamada et al. ..... 123/509

FOREIGN PATENT DOCUMENTS

JP A-60-17264 1/1985
JP A-62-155130 7/1987
JP U-1-114998 8/1989
JP U-1-163413 11/1989
JP 2001-132568 5/2001
JP A-2004-28040 1/2004
JP A-2004-124844 4/2004

OTHER PUBLICATIONS

Examination Report dated Nov. 9, 2007 in CN Application No. 200510134108.0 with English translation.
Japanese Official Action dated Sep. 18, 2008, issued in counterpart Japan Application No. 2004-376261 with English translation.

* cited by examiner

*Primary Examiner*—Mahmoud Gimie
(74) *Attorney, Agent, or Firm*—Nixon & Vanderhye PC

(57) ABSTRACT

A fuel feed apparatus supplies fuel in a fuel tank to an outside of the fuel tank. The fuel feed apparatus includes a fuel pump that is accommodated in the fuel tank. The fuel pump pumps fuel in the fuel tank. The suction filter connects with an inlet of the fuel pump. The suction filter is arranged in a bottom portion of the fuel tank. The suction filter removes foreign matters contained in fuel drawn into the fuel pump. The holder engages with a lateral portion of the suction filter. The holder restricts the suction lifter from moving in a lateral direction of the suction filter.

18 Claims, 6 Drawing Sheets

FUEL FEED APPARATUS HAVING FUEL PUMP AND FILTER

CROSS REFERENCE TO RELATED APPLICATIONS

This application is based on and incorporates herein by reference Japanese Patent Application No. 2004-376261 filed on Dec. 27, 2004.

FIELD OF THE INVENTION

The present invention relates to a fuel feed apparatus having a fuel pump accommodated in a fuel tank.

BACKGROUND OF THE INVENTION

According to JP-A-2001-132568, an in-tank type fuel feed apparatus has a fuel pump accommodated in a fuel tank. The fuel pump pumps fuel in the fuel tank. Foreign matters are removed from fuel drawn into the fuel pump through a suction filter. A pump module including the fuel pump and the suction filter are received in a sub-tank, which has a limited space. The suction filter is provided to a bottom portion of the sub-tank. In this structure, the suction filter is restricted from moving by the sidewall of the sub-tank, so that the suction filter can be restricted from causing ablation relative to the inner bottom surface of the sub-tank, even when vibration is transmitted from the fuel pump and another component to the suction filter.

However, when the fuel feed apparatus does not include a sub-tank, the fuel tank directly accommodates the fuel pump, and the suction filter is provided to the bottom portion of the fuel tank. In this case, the suction filter is not restricted from causing vibration by the sub-tank, and the suction filter may cause ablation relative to the inner bottom surface of the sub-tank.

SUMMARY OF THE INVENTION

In view of the foregoing and other problems, it is an object of the present invention to produce a fuel feed apparatus that is capable of restricting a suction filter from causing ablation.

According to one aspect of the present invention, a fuel feed apparatus supplies fuel in a fuel tank to an outside of the fuel tank. The fuel feed apparatus includes a fuel pump, a suction filter, and a holder. The fuel pump is accommodated in the fuel tank. The fuel pump pumps fuel in the fuel tank. The suction filter connects with an inlet of the fuel pump. The suction filter is arranged in a bottom portion of the fuel tank. The suction filter removes foreign matters contained in fuel drawn into the fuel pump. The holder engages with a lateral portion of the suction filter. The holder restricts the suction filter from moving in a lateral direction of the suction filter.

Thus, the suction filter can be restricted by the holder, so that the suction filter can be restricted from causing ablation relative to the fuel tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1A:
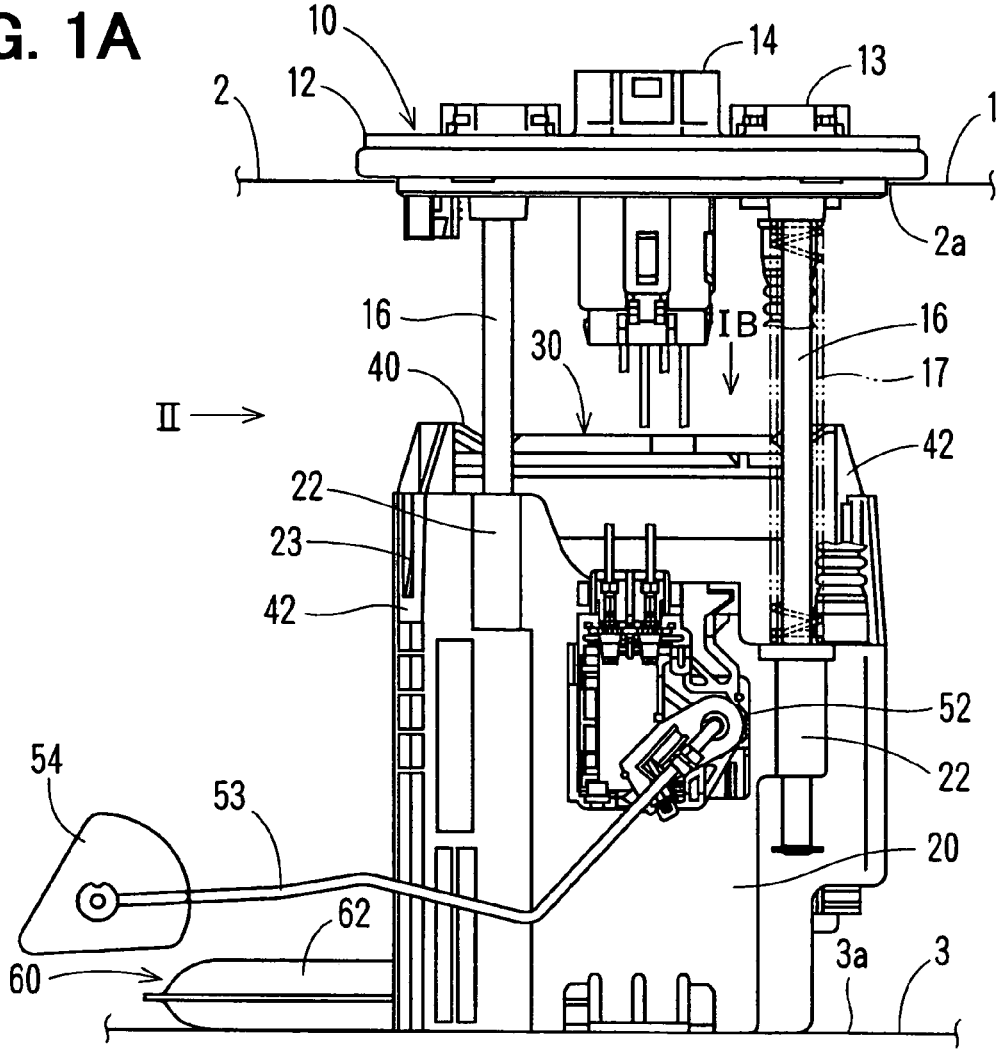
FIG. 1A is a side view showing a fuel feed apparatus.
Figure 1B:
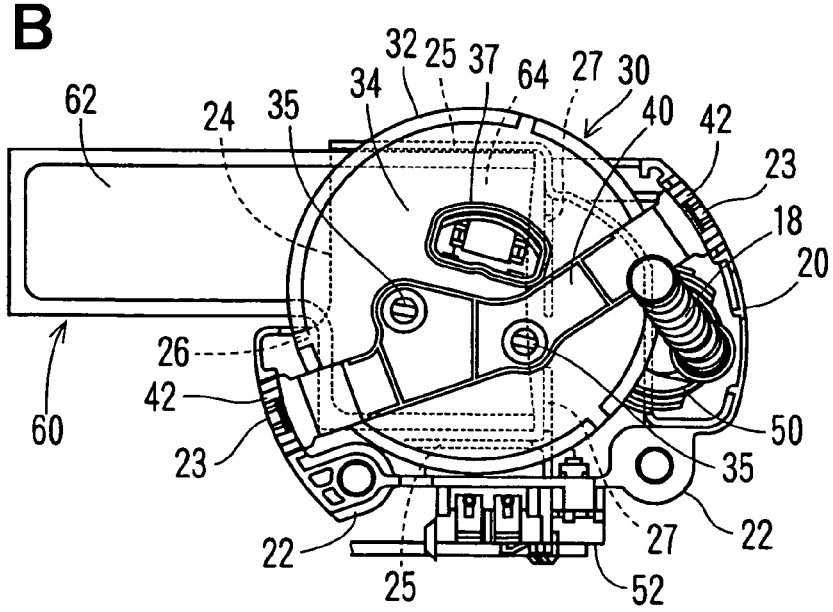
FIG. 1B is a top view showing the fuel feed apparatus, according to a first embodiment of the present invention.
Figure 2:
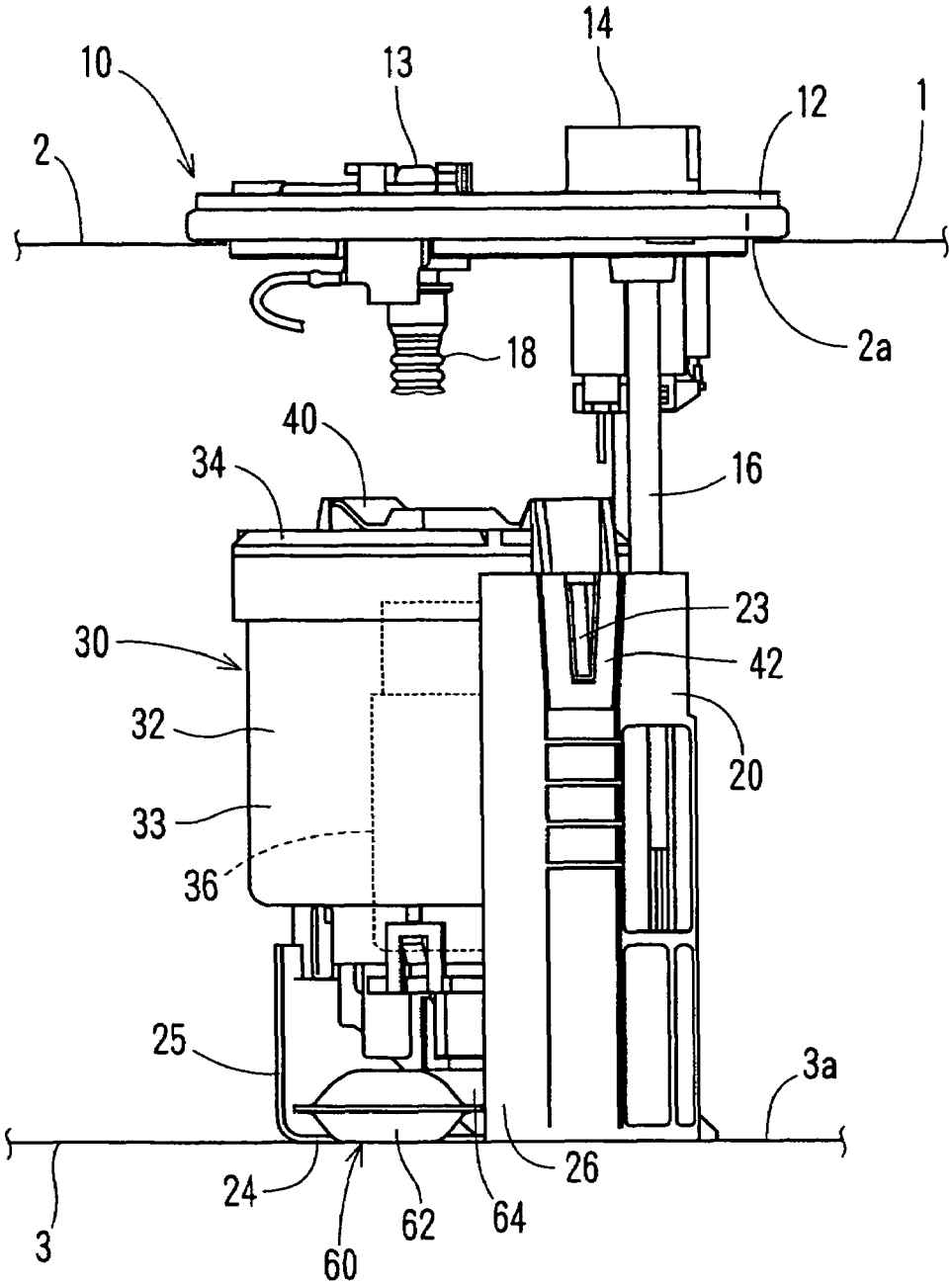
FIG. 2 is a side view when being viewed from the allow II in FIG. 1A according to the first embodiment.
Figure 3A:
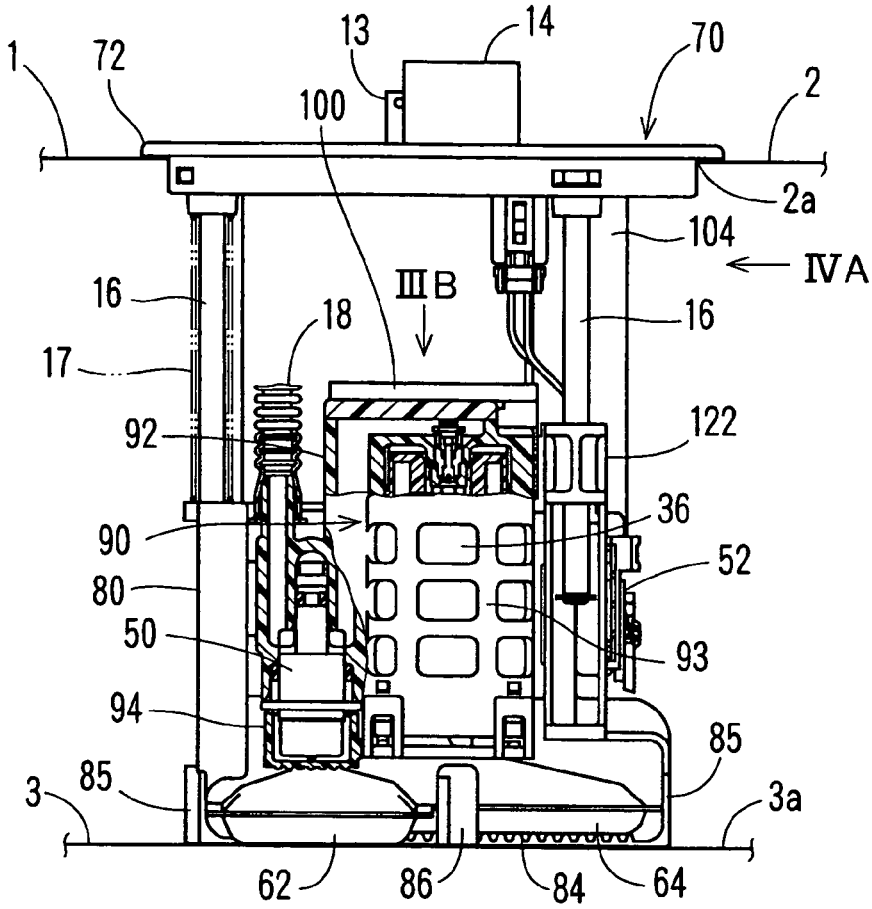
FIG. 3A is a partially cross sectional side view showing a fuel feed apparatus.
Figure 3B:
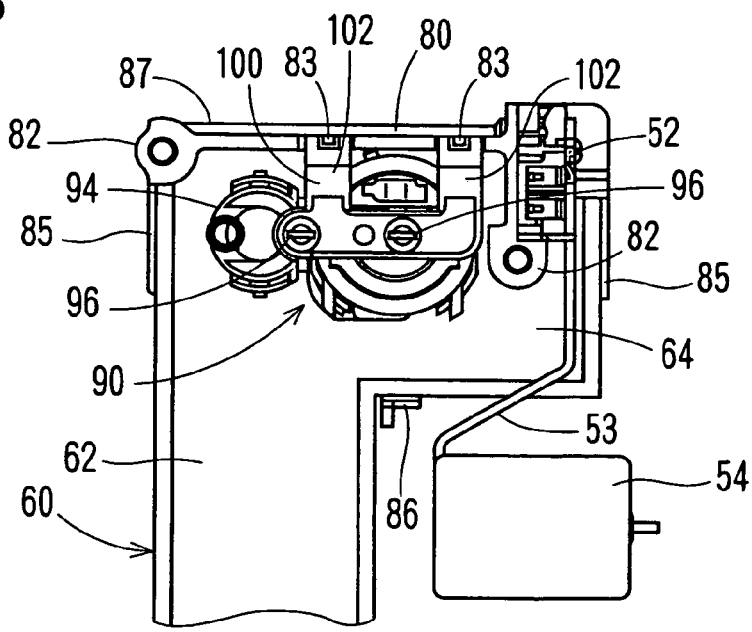
FIG. 3B is a top view showing the fuel feed apparatus, according to a second embodiment of the present invention.
Figure 4A:
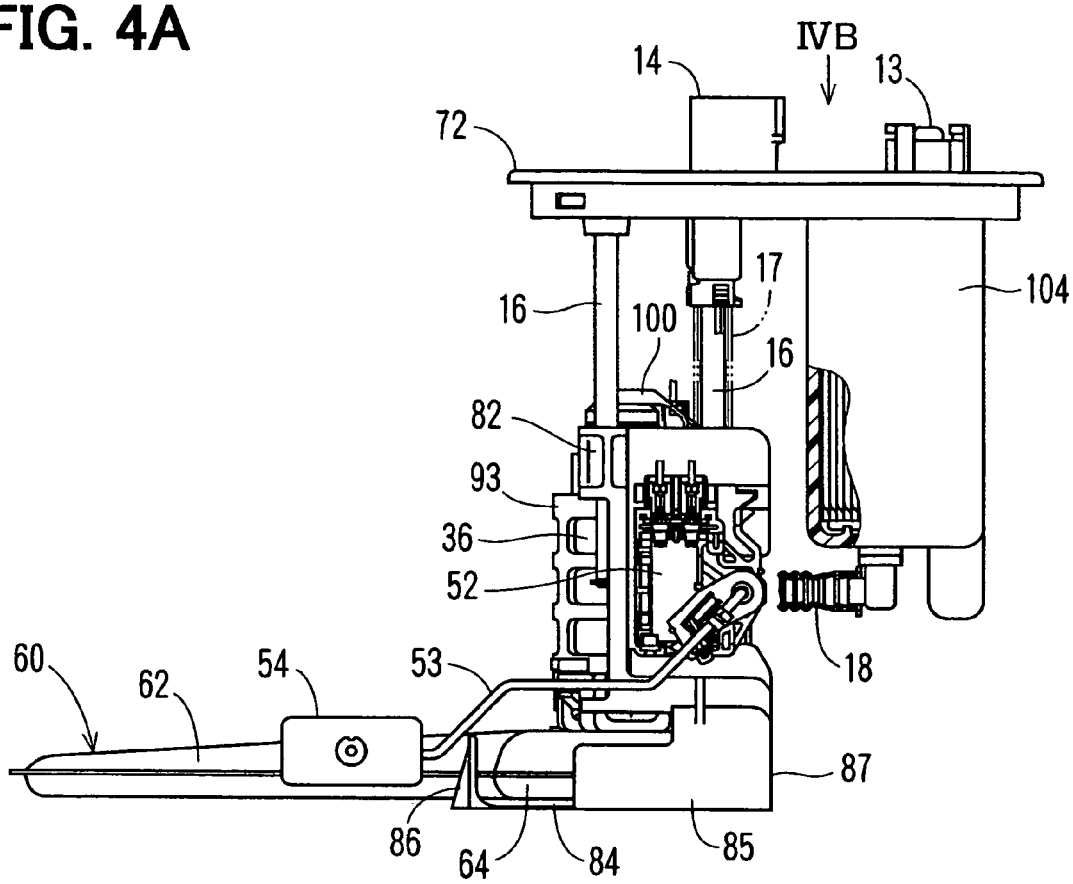
FIG. 4A is a side view when being viewed from the allow IVA in FIG. 3A.
Figure 4B:
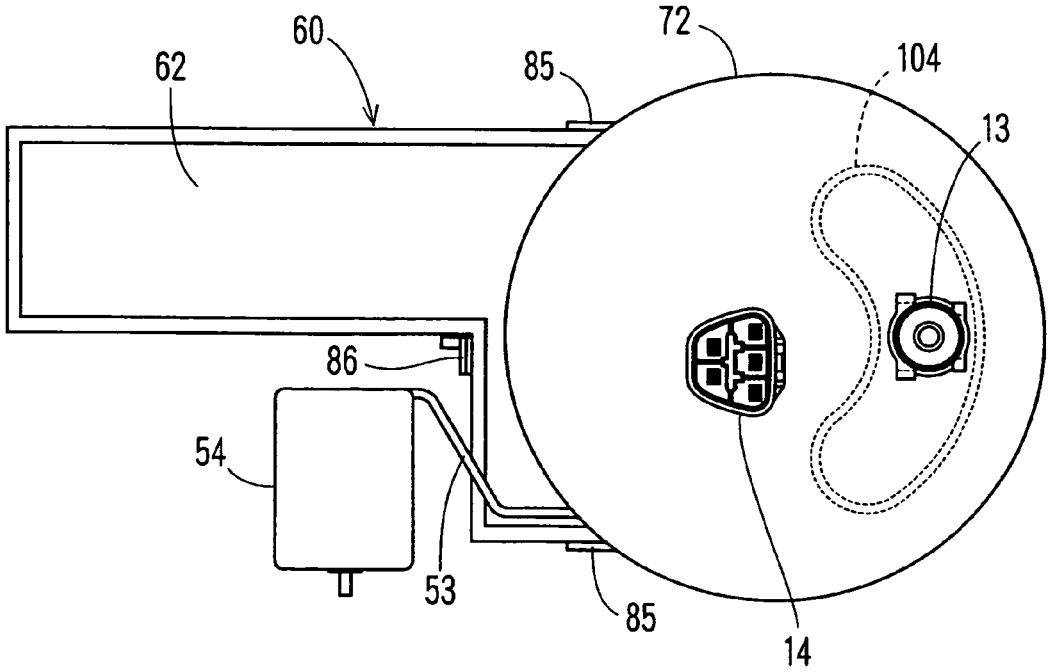
FIG. 4B is a top view when being viewed from the allow IVB in FIG. 4A, according to the second embodiment.
Figure 5A:
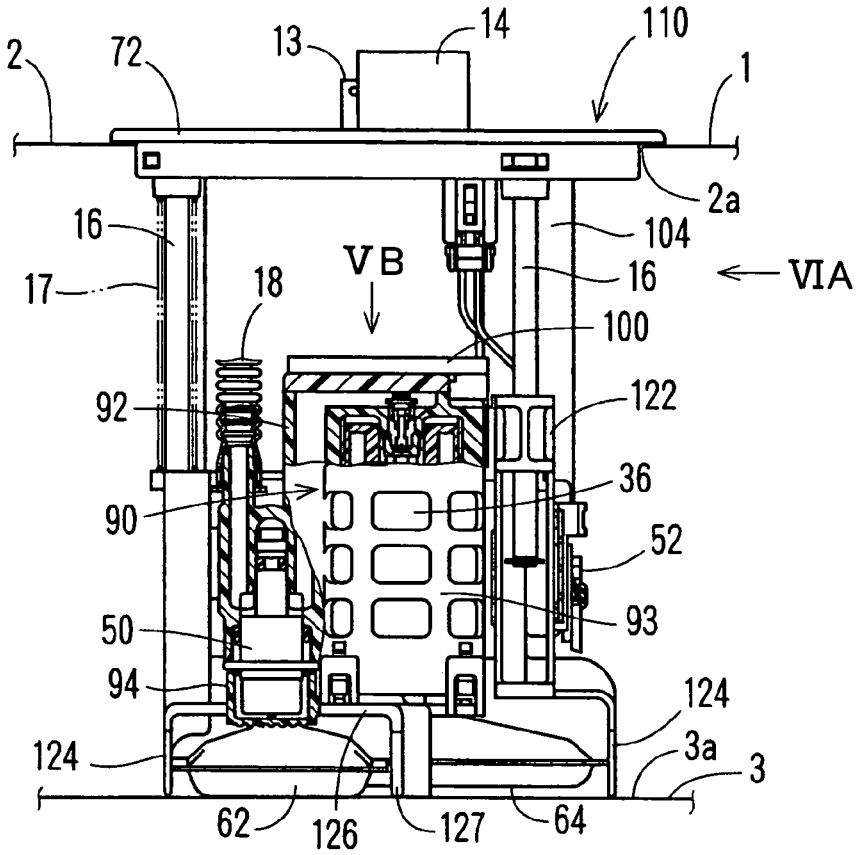
FIG. 5A is a partially cross sectional side view showing a fuel feed apparatus.
Figure 5B:
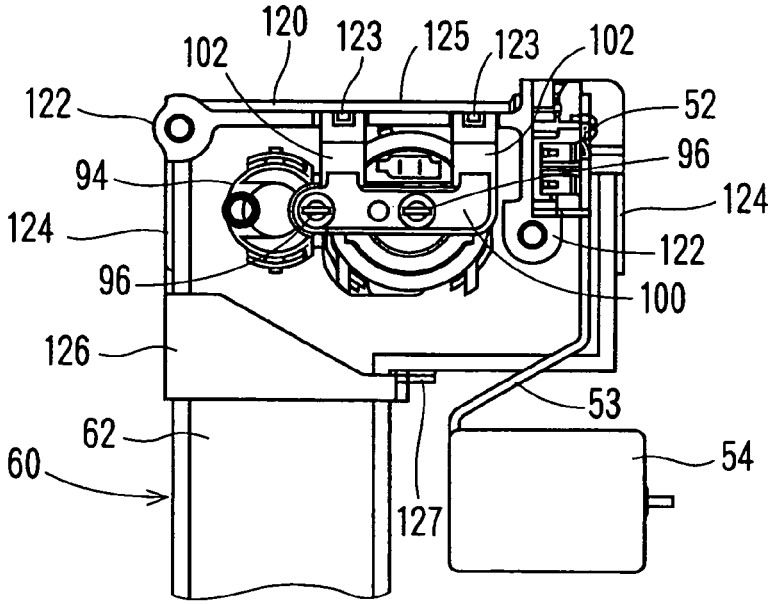
FIG. 5B is a top view showing the fuel feed apparatus, according to a third embodiment of the present invention.
Figure 6A:
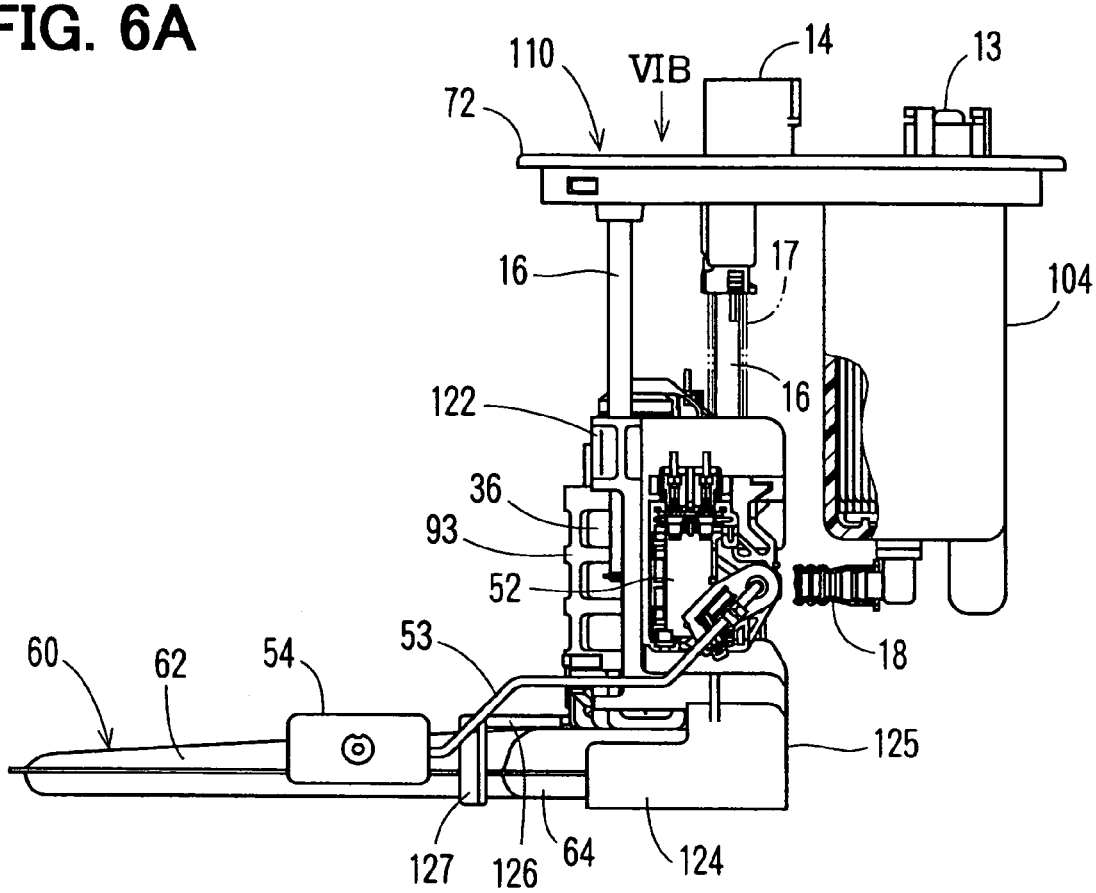
FIG. 6A is a side view when being viewed from the allow VIA in FIG. 5A.
Figure 6B:
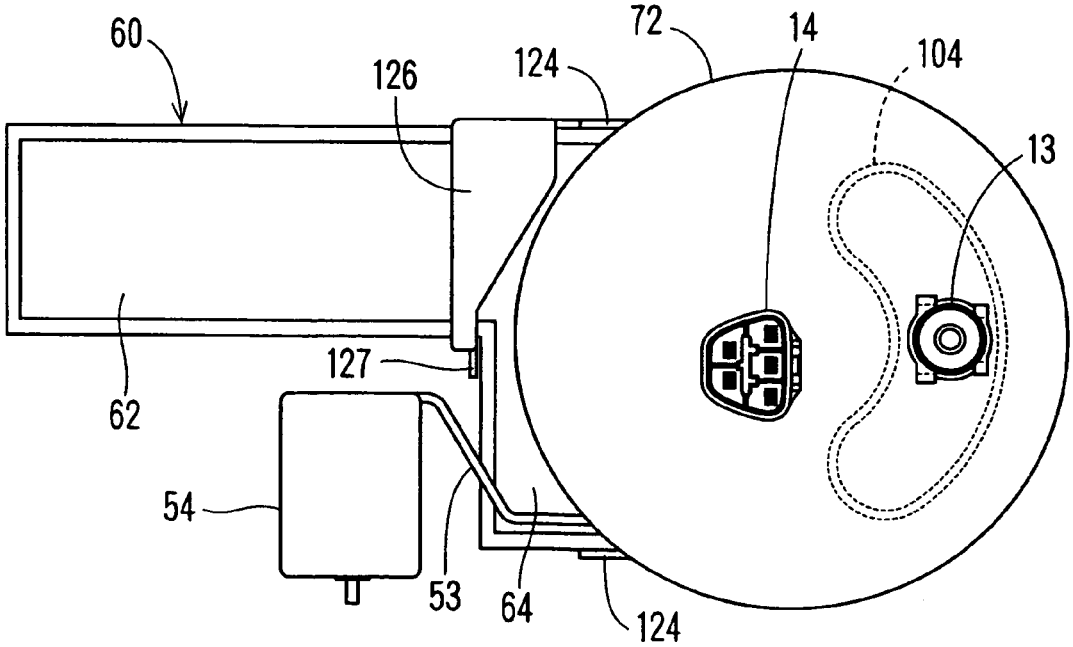
FIG. 6B is a top view when being viewed from the allow VIB in FIG. 6A, according to the third embodiment.

As shown in FIGS. 1A to 2, a fuel feed apparatus 10 has a lid member 12, which is formed of resin to be in a substantially disc-shape. The lid member 12 covers an opening 12*a* formed in an upper wall 2 of a fuel tank 1. The furl feed apparatus 10 excluding the lid member 12 is accommodated in the fuel tank 1. The fuel tank 1 is formed of one of resin and metal.

The lid member 12 is connected with a fuel outlet 13 and an electric connector 14. The fuel outlet 13 introduces fuel discharged from a fuel pump 36 of a pump module 30 to the outside of the fuel tank 1. The fuel pump 36 is supplied with electricity via the electric connector 14 and lead wires. A level meter 52 transmits a detection signal of liquid level in the fuel tank 1 to the outside of the fuel tank 1 via the electric connector 14.

Metallic pipes 16 serve as connecting members. Each metallic pipe 16 has one end that is press-inserted into the lid member 12. Each metallic pipe 16 has the other end that is loosely inserted into an inserted portion 22, which is formed in a holder 20. A spring 17 biases the lid member 12 and the holder 20 such that the lid member 12 and the holder 20 depart from each other. Thus, the holder 20 is regularly pressed onto an inner bottom surface 3*a* of a bottom wall 3 of the fuel tank by resiliency of the spring 17. The holder 20 is integrally formed of resin. The holder 20, which is in a substantially arc shape, covers the outer circumferential periphery of a fuel filter 32. The suction filter 60 has an expanded portion 64, which is in a substantially rectangular shape. The expanded portion 64 is mounted on the bottom wall 24 of the holder 20. The holder 20 has engaging portions 25, 26, 27 that engage with a lateral portion of the expanded portion 64. The engaging portion 26 further engages with a lateral portion of a tip end portion 62 of the suction filter 60.

The pump module 30 includes the fuel filter 32, the fuel pump 36, a pressure regulator 50, and the suction filter 60. The fuel filter 32 includes a filter case that is constructed of a casing body 33 and a lid 34. This filter case accommodates a filter element. The fuel filter 32 covers the outer circumferential periphery of the fuel pump 36. The filter case of the fuel filter 32 serves as a pump casing that covers the fuel pump 36. The casing body 33 is connected with lid 34 by welding, for example. The fuel pump 36 has a connector portion 37 (FIG. 1B) that is exposed from the lid 34. The fuel pump 36 accommodates a motor (not shown) and a rotating member such as an impeller that rotates with the motor. The fuel pump 36 pressurizes fuel drawn through the suction filter 60 using the rotating member.

As referred to FIG. 2, the lid 34 of the fuel filter 32 connects with the holder 20 via a resilient member 40 on the upper side of the suction filter 60. The resilient member 40 is integrally formed of a thin plate, for example. The resilient member 40 is snap-fitted to a protrusion 35 (FIG. 1B) of the lid 34, and is snap-fitted to claws 23 via arms 42. The claws 23 are formed in the peripheral wall of the holder 20. In this structure, the holder 20 supports the pump module 30 via the resilient member 40. That is, the holder 20 supports the fuel filter 32, the fuel pump 36, the pressure regulator 50, and the suction filter 60 via the resilient member 40.

The pressure regulator 50 has an inlet port that connects with an outlet port (not shown) of the casing body 33. Fuel is discharged from the fuel pump 36, and foreign matters are removed from the fuel through the fuel filter 32. The pressure regulator 50 controls pressure of the fuel after passing through the fuel filter 32. The fuel, which is controlled in pressure, is introduced into the fuel outlet 13 through a bellows pipe 18.

The level meter 52 is supported by the peripheral wall of the holder 20. The level meter 52 connects with a float 54 via an arm 53.

The suction filter 60 is integrally formed of the tip end portion 62 and the expanded portion 64. The tip end portion 62 is narrow in width thereof. The expanded portion 64 is formed on the side of the inlet side of the fuel pump 36. The suction filter 60 connects with the inlet of the fuel pump 36. The suction filter 60 is snap-fitted to the bottom portion of the casing body 33, thereby being supported by the bottom portion of the casing body 33. The outer periphery of the suction filter 60 is covered with non-woven fabric formed of resin, for example. This non-woven fabric serves as a filtering member. The suction filter 60 removes relatively large foreign matters, which are contained in fuel drawn from the fuel tank 1 into the fuel pump 36. The tip end portion 62 of the suction filter 60 directly makes contact with the bottom wall 3 of the fuel tank 1. The expanded portion 64 of the suction filter 60 is mounted onto the bottom wall 24 of the holder 20.

Next, the structure of the holder 20 is described.

The holder 20 restricts vibration of the suction filter 60. As referred to FIG. 1B, the holder 20 has a pair of the engaging portions 25, and the engaging portions 26, 27. The engaging portions 25, 26, and 27 are provided to the lower side of the holder 20. The engaging portions 25, 26, and 27 engage with four peripheral lateral portions of the expanded portion 64, which is in the substantially rectangular shape, all together. The engaging portion 26 engages with a portion of the lateral periphery of the tip portion 62. Thus, the suction filter is restricted from moving in the lateral direction.

In this structure, the suction filter 60 is restricted from causing vibration using the engaging portions 25, 26, and 27, even when vibration is transmitted from the fuel pump 36 and outer components to the suction filter 60. As a result, the suction filter 60 can be restricted from sliding relative to the bottom wall 24 of the holder 60 and the bottom wall 3 of the fuel tank 1, so that the suction filter 60 can be restricted from causing ablation.

The expanded portion 64 of the suction filter 60 is mounted onto the bottom wall 24 of the holder 20, so that the expanded portion 64 does not make contact with the bottom wall 3 of the fuel tank 1. Therefore, the bottom wall 3 of the fuel tank 1 does not slide relative to the expanded portion 64, even when the holder 20, which restricts the suction filter 60 from laterally moving, causes vibration. Thus, the expanded portion 64 can be restricted from causing ablation.

The pump module 30 connects with the resilient member 40 on the upper side of the pump module 30. The pump module 30 connects with one of the fuel tank 1 and the holder 20 on the lower side thereof via the suction filter 60. Therefore, vibration of the fuel pump 36 is absorbed by the resilient member 40. Thus, vibration of the fuel pump 36 transmitted to the suction filter 60 can be reduced.

Second Embodiment

As shown in FIGS. 3A to 4B, a fuel feed apparatus 70 has a lid member 72, which is in a substantially disc-shape. The lid member 72 covers the opening 2*a* formed in the upper wall 2 of the fuel tank 1. A holder 80 is integrally formed of resin, and is connected with the lid member 72 via the metallic pipes 16. Each one end of each metallic pipe 16 is loosely inserted into an inserted portion 82 of the holder 80. The spring 17 biases the holder 80 onto the inner bottom surface 3*a* of the bottom wall 3 of the fuel tank 1 by resiliency thereof.

A pump module 90 is constructed of the fuel pump 36, the pressure regulator 50, the suction filter 60, a module case 92, and the like. The module case 92 is formed of resin. The module case 92 is constructed of a pump case 93, and a regulator case 94. The pump case 93 accommodates the fuel pump 36. The regulator case 94 accommodates the pressure regulator 50. The pump case 93 is formed to be in a substantially mesh-shape for reducing weight thereof. The fuel pump 36 discharges fuel, and the fuel is controlled in pressure through the pressure regulator 50, and subsequently, the fuel is introduced into the fuel outlet 13 through the bellows pipe 18 and a fuel filter 104.

A resilient member 100 connects the module case 92 with the holder 80 on the upper side of the suction filter 60. The resilient member 100 is integrally formed of a thin plate, for example. The resilient member 100 is snap-fitted to a protrusion 96 (FIG. 3B) of the module case 92, and is snap-fitted to claws 83 via arms 102. The claws 83 are formed in the peripheral wall of the holder 80. In this structure, the holder 80 supports the pump module 90 via the resilient member 100.

The holder 80 has a bottom wall 84 in the lower side thereof. The expanded portion 64 of the suction filter 60 is mounted onto the bottom wall 84. The holder 80 has a pair of the engaging portions 85, and engaging portions 86, 87. The engaging portions 85, 86, and 87 upwardly extend from the bottom wall 84 of the holder 80. The pair of the engaging portions 85 opposes to each other. The engaging portions 85, 86, and 87 engage with four portions of the lateral periphery of the expanded portion 64 all together. The engaging portion 86 engages with a portion of the lateral periphery of the tip portion 62. Thus, the suction filter 60 is restricted from moving in the lateral direction thereof.

In this structure, the suction filter 60 is restricted from causing vibration using the engaging portions 85, 86, and 87, even when vibration is transmitted from the fuel pump 36 and outer components to the suction filter 60. As a result, the suction filter 60 can be restricted from sliding relative to the bottom wall 84 of the holder 80 and the bottom wall 3 of the fuel tank 1, so that the suction filter 60 can be restricted from causing ablation.

The expanded portion 64 of the suction filter 60 is mounted onto the bottom wall 84 of the holder 80, so that the expanded portion 64 is restricted from sliding relative to the bottom wall 3 of the fuel tank 1. In this embodiment, as referred to FIG. 3A, the regulator case 94 has a contact surface, via which the regulator case 94 makes contact with the tip end portion 62 of the suction filter 60. The bottom wall 84 makes contact with the expanded portion 64 of the suction filter 60. The contact surfaces of the regulator case 94 and the bottom wall 84 are respectively formed in waved-shapes, so that the regulator case 94 and the tip end portion 62 form a gap therebetween, and the bottom wall 84 and the expanded portion 64 form a gap therebetween. Fuel flows into both the gap, which is between the regulator case 94 and the tip end portion 62, and the gap, which is between the bottom wall 84 and the expanded portion 64. Thus, the fuel pump 36 can draw fuel through the suction filter 60.

Third Embodiment

As shown in FIGS. 5A to 6B, a fuel feed apparatus 110 has a holder 120 that is integrally formed of resin, and is connected with the lid member 72 via the metallic pipes 16. Each one end of each metallic pipe 16 is loosely inserted into an inserted portion 122 of the holder 120. The spring 17 biases the holder 120 onto the inner bottom surface 3*a* of the bottom wall 3 of the fuel tank 1 by resiliency thereof.

A resilient member 100 connects the module case 92 with the holder 120 on the upper side of the suction filter 60. The resilient member 100 is snap-fitted to a protrusion 96 of the module case 92, and is snap-fitted to claws 123 via arms 102. The claws 123 are formed in the peripheral wall of the holder 120. In this structure, the holder 120 supports the pump module 90 via the resilient member 100.

The holder 120 does not cover the bottom surface of the suction filter 60, dissimilarly to the holder 80 in the second embodiment. The holder 120 has a pair of the engaging portions 124, and an engaging portion 125. The engaging portions 124, 125 are formed as parts of the peripheral wall of the holder 120. The holder 120 has a connecting portion 126, which is arranged upwardly relative to the suction filter 60. The holder 120 connects one side of the engaging portion 124 with an engaging portion 127. The pair of the engaging portions 124 opposes to each other. The engaging portions 124, 125, and 127 engage with four portions of the lateral periphery of the expanded portion 64 all together. The engaging portion 127 engages with a portion of the lateral periphery of the tip portion 62. Thus, the suction filter 60 is restricted from moving in the lateral direction thereof.

In this structure, the suction filter 60 is restricted from causing vibration using the engaging portions 124, 125, and 127, even when vibration is transmitted from the fuel pump 36 and outer components to the suction filter 60. As a result, the suction filter 60 can be restricted from sliding relative to the bottom wall 3 of the fuel tank 1, so that the suction filter 60 can be restricted from causing ablation.

In the above embodiment, the holder engages with the portions of the lateral periphery of the suction filter 60, thereby restricting the suction filter 60 from laterally moving. Thus, the suction filter 60 is restricted from causing vibration, even when vibration is transmitted from the fuel pump 36 and outer components to the suction filter 60. In this structure, the suction filter 60 is restricted from sliding relative to at least one of the holder and the fuel tank 1, so that the suction filter 60 can be restricted from causing ablation.

In particular, when the fuel tank 1 is formed of metal, the suction filter 60 is apt to cause ablation, in the case where the suction filter 60, which is covered with resinous non-woven fabric, for example, slides relative to the bottom wall 3 of the fuel tank 1. Therefore, the suction filter 60 needs to be restricted from arising ablation by engaging the holder with the suction filter 60, so that the suction filter 60 can be prohibited from vibrating.

As described in the first and second embodiments, the connecting portions between the fuel tank 1 and the suction filter 60 are reduced by covering the suction filter 60 at least partially with the holder formed of resin. This structure is effective for restricting the suction filter 60 from causing ablation, in particular, when the fuel tank is formed of metal. In addition, the pump module is supported by the holder via the resilient member, so that vibration of the fuel pump 36 can be absorbed by the resilient member. Thus, vibration of the fuel pump 36 transmitted to the suction filter 60 can be reduced.

The holder does not have to support the pump module directly or indirectly. The holder may engage with the lateral portion of the suction filter, so that the holder may restrict the suction filter from laterally moving, without supporting the pump module directly or indirectly. The holder may entirely cover the bottom surface of the suction filter.

The holder may support the suction filter such that the bottom portion of the suction filter at least partially floats from the bottom surface of the fuel tank. In this structure, the holder need to cover the bottom portion of the suction filter.

The above structures of the embodiments can be combined as appropriate.

Various modifications and alternations may be diversely made to the above embodiments without departing from the spirit of the present invention.

What is claimed is:

1. A fuel feed apparatus that supplies fuel in a fuel tank to an outside of the fuel tank, the fuel feed apparatus comprising:

a fuel pump that is accommodated in the fuel tank, the fuel pump pumping fuel in the fuel tank;

a suction filter that connects with an inlet of the fuel pump, the suction filter being arranged in a bottom portion of the fuel tank, the suction filter removing foreign matters contained in fuel drawn into the fuel pump; and a holder that connects with a lateral portion of the suction filter, wherein the holder restricts the suction filter from moving in a lateral direction of the suction filters, the holder covers only a part of a bottom surface of the suction filter, and a remainder of the bottom surface of the suction filter is disposed adjacent to a bottom surface of the fuel tank in the absence of intervening structure.

2. The fuel feed apparatus according to claim 1, further comprising:

a lid member that covers an opening of the fuel tank; and a connecting member that connects with the lid member and the holder, wherein the connecting member supports the holder.

3. The fuel feed apparatus according to claim 1, further comprising:

a level meter that detects liquid level in the fuel tank, wherein the holder supports the level meter.

4. The fuel feed apparatus according to claim 1, wherein the holder supports the fuel pump.

5. The fuel feed apparatus according to claim 4, further comprising:

a resilient member that connects the fuel pump with the holder on an upper side of the suction filter, wherein the resilient member is resilient, and the holder supports the fuel pump via the resilient member.

6. The fuel feed apparatus according to claim 1, further comprising:

a regulator that controls pressure of fuel discharged from the fuel pump, wherein the holder supports the regulator.

7. The fuel feed apparatus according to claim 1, wherein the fuel tank is formed of a metallic material.

8. The fuel feed apparatus according to claim 7, wherein the suction filter is formed of non-woven fabric.

9. The fuel feed apparatus according to claim 1, wherein the holder supports the suction filter such that the suction filter at least partially floats from a bottom wall of the fuel tank.

10. The fuel feed apparatus according to claim 9, wherein the holder is away from a bottom surface of the suction filter.

11. The fuel feed apparatus according to claim 1, wherein the holder engages with the lateral portion of the suction filter.

12. The fuel feed apparatus according to claim 1, wherein the bottom surface of the suction filter is at least partially directly in contact with the bottom surface of the fuel tank.

13. The fuel feed apparatus according to claim 12, wherein the bottom surface of the suction filter is biased onto the bottom surface of the fuel tank.

14. The fuel feed apparatus according to claim 1, wherein the holder engages first and second lateral portions of the suction filter.

15. The fuel feed apparatus according to claim 1, wherein the suction filter includes an expanded portion and a tip end portion projecting from the expanded portion, and wherein the holder engages a lateral portion of the expanded portion of the suction filter.

16. The fuel feed apparatus according to claim 15, wherein the holder engages first and second lateral portions of the expanded portion of the suction filter.

17. The fuel feed apparatus according to claim 15, wherein at least a portion of the bottom surface of the tip end portion directly makes contact with the bottom wall of the fuel tank.

18. The fuel feed apparatus according to claim 15, wherein the expanded portion of the suction filter is mounted onto the bottom wall of the holder which in turn is directly in contact with the bottom wall of the fuel tank.

* * * * *